United States Patent [19]

Morooka

[11] 4,171,582

[45] Oct. 23, 1979

[54] EXCAVATOR

[75] Inventor: Kazuo Morooka, Ryugasaki, Japan

[73] Assignee: Morooka Co. Ltd., Ryugasaki, Japan

[21] Appl. No.: 888,572

[22] Filed: Mar. 20, 1978

Related U.S. Application Data

[63] Continuation of Ser. No. 764,025, Jan. 31, 1977, abandoned.

[30] Foreign Application Priority Data

Jan. 31, 1977 [JP] Japan ..... 51-31657

[51] Int. Cl.[2] ..... E02F 5/06

[52] U.S. Cl. ..... 37/90; 198/705

[58] Field of Search ..... 37/83, 90, 94, 189, 37/190, 86; 198/703-707, 712, 715

[56] References Cited

U.S. PATENT DOCUMENTS

| | | | |
|---|---|---|---|
| 1,764,949 | 6/1930 | George | 198/705 |
| 1,871,856 | 8/1932 | MacDonald | 37/90 |
| 1,892,521 | 12/1932 | Vaughn et al. | 37/90 |
| 2,747,307 | 5/1956 | Griffin | 37/90 |
| 3,203,119 | 8/1965 | Penote et al. | 37/90 |

FOREIGN PATENT DOCUMENTS

| | | | |
|---|---|---|---|
| 1143939 | 2/1969 | United Kingdom | 37/90 |

*Primary Examiner*—E. H. Eickholt

*Attorney, Agent, or Firm*—George B. Oujevolk

[57] ABSTRACT

A plurality of sets of an excavating vessel and an associated soil discharging plate are mounted on an endless rotary member in an excavator in such a manner that said excavating vessel goes behind said associated soil discharging plate and the free end of said associated soil discharging plate is placed well into said excavating vessel so that said free end can discharge the soil excavated and contained in said excavating vessel at a predetermined position and, thus, the excavation and soil discharging works can be performed in a continuous and synchronized fashion.

1 Claim, 7 Drawing Figures

FIG. 2
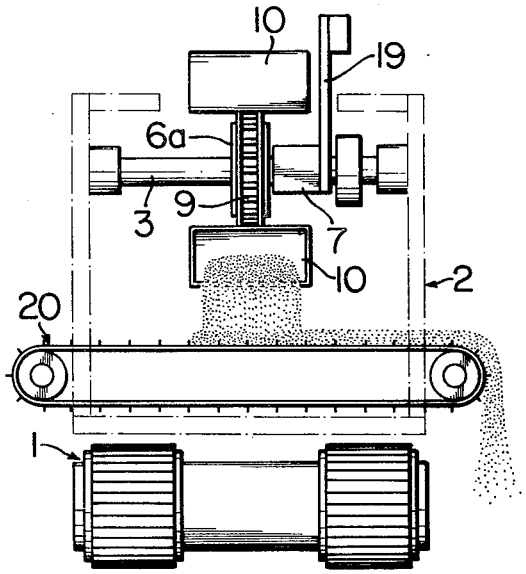
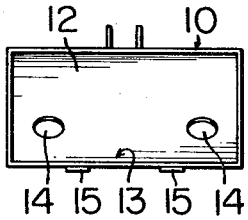
FIG. 3a
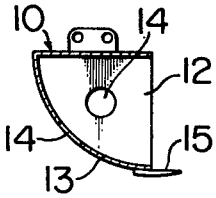
FIG. 3b
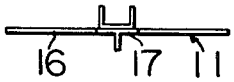
FIG. 4a
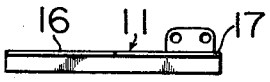
FIG. 4b
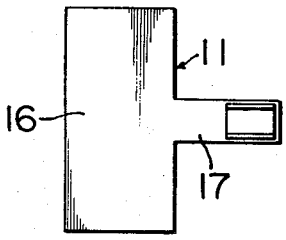
FIG. 4c

EXCAVATOR

This is a continuation, of application Ser. No. 764025 filed 1-31-1977 and now abandoned.

The present invention is related to an excavator for performing excavating works in and under ground surfaces such as the excavating of grooves.

Heretofore, there have been proposed various kinds of excavators for an exclusive use to the excavation of grooves which is provided on the peripheral surface of an endless rotary member thereof with excavating vessel such as cutters, and such kinds of excavators can be broadly divided into the first type having only the excavating function and the second type which has the soil conveying function in addition to the excavating function. In the first type of excavators, since the excavated soil must be discharged out of the groove after a predetermined amount of soil has been excavated under the ground surface, the overall working efficiency inclusive of the excavation to the soil conveying (discharging) works is necessarily subjected to a remarkable decrease. While, in the second type of excavators comprising an excavating mechanism and a soil conveying mechanism, although such a remarkable decrease in the working efficiency is found when the soil discharging works is performed completely separately from the excavation is not encountered because the soil discharging work is performed succeedingly to the preceding excavation at a predetermined interval in time and space, the working efficiency provided thereby is far from satisfactory in that the excavation and the soil discharging work are not performed in a completely unified and synchronized fashion.

Further, in the second type of excavators incorporating the excavating and soil conveying functions in one unit of machine as well as in the first type requiring an excavator and a soil conveyor separately, economy in the equipment of machines has not been achieved due to the necessity of a large-scaled mechanism for conveying the soil in association with the excavation such as, for example, a power shovel.

Accordingly, an object of the present invention is to provide an excavator utilizing an endless rotary member in which excavating vessels of bucket type and soil discharging plates are mounted on said endless rotary member in such a manner that the excavation and the soil conveying and discharging works can be performed continuously at a stretch and, thereby, to achieve a high working efficiency and improve economy in the equipment of machines.

The aforementioned and other objects and features of the present invention will be obvious from the following detailed description of a preferred embodiment of the present invention taken with reference to the accompanying drawings, in which:

FIG. 2 is a schematic front view of the excavator shown in FIG. 1, showing the state of the endless rotary member thereof discharging the excavated soil from the base end thereof;

Figure 1:
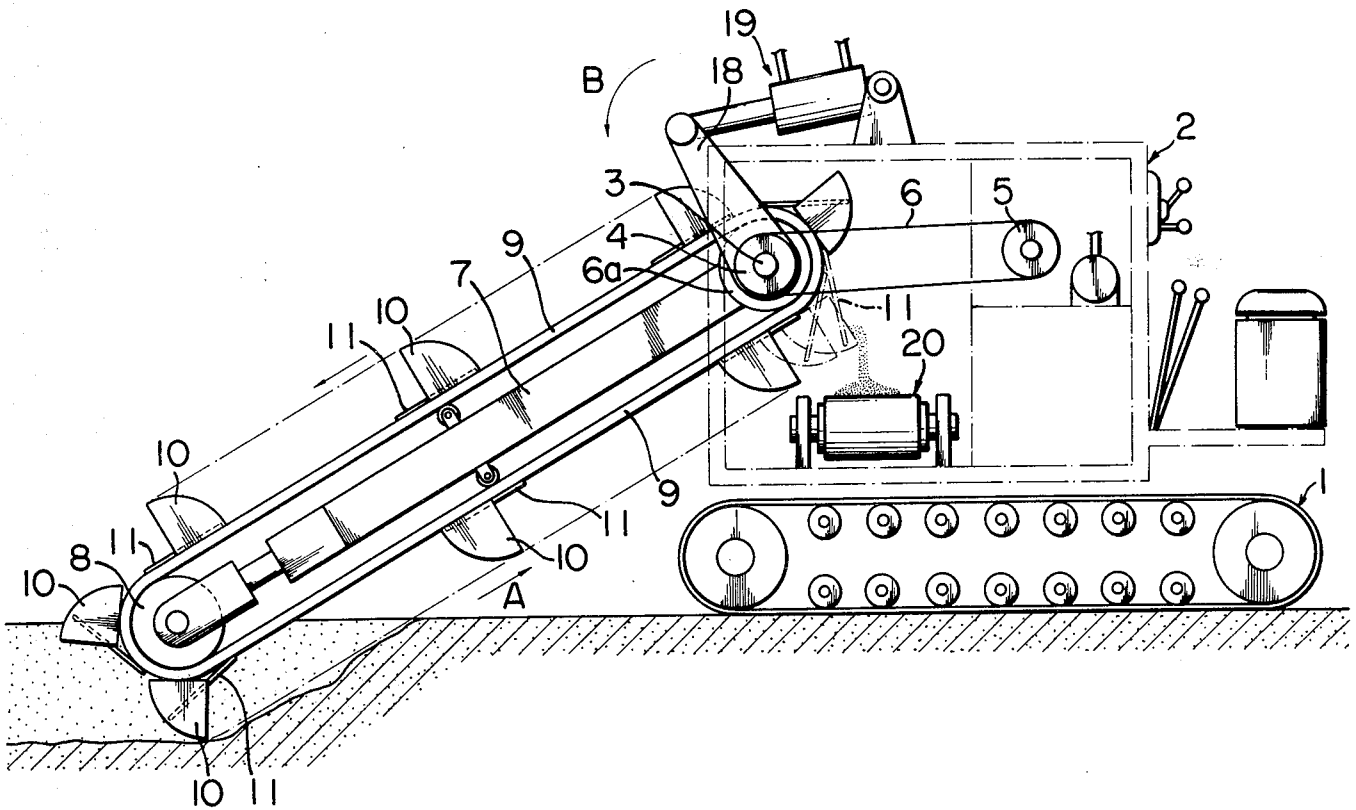
FIG. 1 is a schematic side view of a preferred embodiment of the excavator according to the present invention.

FIGS. 3(*a*) and (*b*) are a frontal view and a section, respectively, of an excavating vessel adopted in the excavator according to the present invention; and FIGS. 4(*a*), (*b*) and (*c*) are a side view, a front view and a plan view of a soil discharging plate, respectively, of a soil discharging plate used in the excavator according to the present invention.

Referring now to the drawings, the numeral (1) indicates a crawler on which a frame (2) is provided, and (3) is a rotatable shaft mounted on the frame (2) on the rear side thereof as seen in FIG. 1. The rotatable shaft (3) is rotationally driven by a motor means (not shown) directly coupled to a driving pulley (5) disposed at a predetermined position within the frame (2), through a driven pulley mounted onto the shaft (3), said driving pulley (5), a belt (6) stretched b between said driving pulley (5) and driven pulley (4) and a reduction gear.

6(*a*) is a sprocket gear mounted onto said rotatable shaft (3), while (7) is an elevating rod having the base end thereof loosely fitted onto said rotatable shaft (3) and the angle of elevation of which is freely variable. At the other end of the elevating rod (7), namely at the rearmost end thereof as seen in FIG. 1, a sprocket gear (8) is provided. Between the sprocket gear (6*a*) on the side of the rotatable shaft (3) and the sprocket gear (8) at the rearmost end of the elevating rod (3), an endless rotary member (9) comprising a chain belt or the like means is stretched.

Further, on and along the peripheral surface of the endless rotary member (9), a plurality of sets of an excavating vessel (10) of bucket type and a soil discharging plate (11) are mounted spaced apart a predetermined interval from each other in such a manner that each of the excavating vessels (10) goes behind each of the soil discharging plates (11) as seen in the moving direction of the upper side of the endless rotary member (9) and the free end of each of the soil discharging plates (11) is placed well into each of the excavating vessels.

As shown in detail in FIGS. 3 and 4, each of the excavating vessels (10) is constructed in a bucket shape having an opening (12) on the front thereof and a curved portion (13) extending from the bottom to the back side thereof. Also, water draining apertures (14) are formed on said curved portion (13) and the sides of the excavating vessels (10), and a cutter (15) for the excavation is provided on the front edge of the excavating vessels (10). The soil discharging plate (11) also has a configuration as shown in FIGS. 3 and 4.

As shown in the drawings, the soil discharging plate (11) is composed of a rear portion (16) of wider area to be placed in the excavating vessel (10) and a remaining portion (17) of band plate shape.

In the drawings, the numeral (18) denotes an elevation control plate which is orthogonally mounted to the base end of the rotary member, and (19) is a hydraulic or pneumatic expansion shaft which is coupled to the other end of said elevation control plate (18). (20) is a soil discharging coveyor which is disposed on the side of the base end of the endless rotary member (9) and which can be driven both in the rotary member (9) and which can be driven both in the forward and the reverse directions. Said conveyor (20) has its shafts also born on the frame (2).

In operation, the excavator having the aforementioned arrangement according to the present invention is used for excavating the soil in and under the ground surface in the following manner. That is to say, the endless rotary member (9) is rotated in the direction as indicated by an arrow A in FIG. 1 and, at the same time, the elevating rod (7) and the elevation control plate (18) are rotated in the direction as indicated by an arrow B in FIG. 1 by adjusting the degree of extension of the expansion shaft (19) so as to cause the front end (as seen in the moving direction of the upper side of the endless rotary member) to come into contact with the ground surface so that the respective excavating vessel (10) mounted on the endless rotary member (9) can excavate the ground successively.

In this case, the ground is excavated by the excavating vessel (10) which has been turned back at the front end of the endless rotary member (9) and put into the underside thereof, and the soil thus excavated is placed into the excavating vessel substantially simultaneously with said excavation to be conveyed to the base end of the endless rotary member (9).

Further, at the turnabout position of the endless rotary member (9) on the side of the base end thereof, the soil discharging plate (11) ahead of the associated excavating vessel is rotated in the rotating direction of the endless rotary member (9) in accordance with the turnabout motion of said soil discharging plate (11) prior to that of the associated excavating vessel (10) and, thus, the free end of said soil discharging plate (11) placed in the associated excavating vessel (10) is caused to move toward the opening (12) of said associated excavating vessel (10) on the verge of its turnabout motion. Therefore, the soil contained in the excavating vessel (10) is discharged out thereof at the underside of the base end of the endless rotary member (9) just prior to the turnabout motion of the excavating vessel (10).

Thereafter, the soil discharging plate (11) and the associated excavating vessel (10) are again turned back to the upper side of the endless rotary member (9) and advance toward the front end thereof (as seen in the moving direction of the rotary member) to continuously repeat the excavation, soil conveying and discharging functions in the manner as described hereinbefore.

In the meantime, the soil discharged out of the excavating vessel (10) at the turnabout position of the endless rotary member (9) on the base and side thereof is dropped onto the soil discharging conver (20) waiting thereunder which is mounted on the frame (2) and, then, transported laterally to the left or right of the crawler (1) by the soil discharging conveyor (20).

In the aforementioned preferred embodiment of the present invention, the excavating vessel (10) of bucket type must be essentially provided with the opening (12) and, preferably, with the curved surface portion (13) extending from the bottom to the back side thereof. More preferably, it is advantageous to compose the curved surface portion (13) of involute curves in view of the soil discharging movement of the soil discharging plate (11) to be associated therewith.

Although the endless rotary member (10) comprises a chain belt in principle, wire ropes or a superhigh-strength belt such as a rubber or a synthetic resin belt in which thin wires or the like strings are embedded may be also adopted. In the latter case, pulleys may be used instead of the sprocket gears (4) and (8).

Further, it should be noted that the elevation control plate (18) for elevating the elevating rod (7) is not necessarily limited to such a particular arrangement as described hereinbefore, but other various types of elevation mechanisms may be also adopted as desired.

As fully described hereinbefore, according to the aforementioned arrangement of the excavator of the present invention in which a plurality of sets of an excavating vessel of bucket type having an opening at the front side thereof and a soil discharging plate associated therewith are mounted on and along the peripheral surface of the endless rotary member in such a manner that said excavating vessel goes behind the associated soil discharging plate in the moving direction of said endless rotary member (9) and the free end of said soil discharging plate (11) is placed well into the associated excavating vessel (10), and said free end of the soil discharging plate (11) is adapted to be moved toward said opening of the associated excavating vessel at the upward turnabout position of said endless rotary member on one end side thereof, the operation of said endless rotary member for merely rotationally moving the same can permit the excavation, soil conveying and discharging functions to be performed in a continuous and synchronized fashion. Therefore, according to the present invention, the efficiency in the excavation works can be almost tenfold as compared with the that in conventional excavators in which the soil conveying and discharging functions are performed separately from the excavation or in which one unit of machine performs the excavation, soil conveying and discharging functions in two or three steps of operation.

Further, according to the present invention, since the major part of the excavator arrangement is constructed by merely mounting a plurality of sets of the excavating vessel and soil discharging plate onto the endless rotary member, the construction of the excavator can be remarkably simplified and, therefore machines of higher performance can be provided at lower costs.

What is claimed is:

1. An excavator mechanism comprising in combination:

(a) a crawler (1) having a front and rear and a box-shaped frame (2) thereon;

(b) an elongated endless rotary member (9) with front and rear turning ends, said member (9) having a moving peripheral surface moved by a rotatable shaft (3) mounted in said frame (2) at the rear thereof, said rotary member extending rearwards and downwards from said frame (2), drive means to rotate said shaft (3);

(c) a plurality of spaced apart excavating bucket type vessels (10) mounted on said peripheral surface, said bucket type vessels having a curved portion (13) extending from the bottom to the rear thereof, each of said vessels (10) having an opening (12) on the front thereof, each of said vessels (10) having at the front thereof a soil discharge plate (11) mounted on said peripheral surface, said soil discharge plate (11) normally resting on one side and having a wide rear portion (16) within the vessel (10) and a band plate (17) extending out of said vessel, the distal end of said band plate (17) being pivotally connected to the peripheral surface and at a location outside of said bucket type vessel (10), said plate (11) pivoting at said front and rear turning ends prior to the corresponding excavating vessel (10);

(d) a soil discharge conveyor (20) orthogonally mounted in said frame (2) disposed in the vicinity of said front turning end to carry soil discharged thereon by said vessels; and, (e) elevation control means including a piston-like expansion shaft (19) with an outer end, said shaft (19) being mounted at the top of said frame (2) and an elevation plate (18) connecting said shaft outer end and said front turning end.

* * * * *